US009511986B2

(12) United States Patent
Clusserath

(10) Patent No.: US 9,511,986 B2
(45) Date of Patent: Dec. 6, 2016

(54) FILLING ELEMENT AND FILLING SYSTEM

(71) Applicant: KHS GmbH, Dortmund (DE)

(72) Inventor: Ludwig Clusserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 210 days.

(21) Appl. No.: 14/366,846

(22) PCT Filed: Oct. 27, 2012

(86) PCT No.: PCT/EP2012/004509
§ 371 (c)(1),
(2) Date: Jun. 19, 2014

(87) PCT Pub. No.: WO2013/091750
PCT Pub. Date: Jun. 27, 2013

(65) Prior Publication Data

US 2014/0366982 A1 Dec. 18, 2014

(30) Foreign Application Priority Data

Dec. 21, 2011 (DE) ..... 10 2011 121 968

(51) Int. Cl.

| | |
|---|---|
| ***B67C 3/26*** | (2006.01) |
| ***B67C 3/02*** | (2006.01) |
| ***B67C 3/28*** | (2006.01) |
| ***B67C 3/22*** | (2006.01) |

(52) U.S. Cl.
CPC ..... *B67C 3/026* (2013.01); *B67C 3/225* (2013.01); *B67C 3/26* (2013.01); *B67C 3/286* (2013.01); *B67C 2003/2671* (2013.01)

(58) Field of Classification Search
CPC ..... B67C 3/023; B67C 3/026; B67C 3/225; B67C 3/26; B67C 3/28; B67C 3/286
USPC ..... 141/9, 100, 105, 301–302
See application file for complete search history.

(56) References Cited

U.S. PATENT DOCUMENTS

| | | | | |
|---|---|---|---|---|
| 8,596,307 | B2 * | 12/2013 | Krulitsch | B67C 3/02 141/102 |
| 8,631,839 | B2 * | 1/2014 | Meinzinger | B67C 3/02 141/104 |
| 8,763,654 | B2 * | 7/2014 | Gras | B67C 3/007 141/104 |
| 8,800,610 | B2 * | 8/2014 | Meinzinger | B67C 3/02 141/105 |
| 8,833,407 | B2 * | 9/2014 | Clusserath | B67C 3/2608 141/115 |
| 8,931,526 | B2 * | 1/2015 | Clusserath | B67C 3/2608 141/311 A |
| 9,108,836 | B2 * | 8/2015 | Clusserath | B67C 3/2622 |

(Continued)

FOREIGN PATENT DOCUMENTS

| | | |
|---|---|---|
| DE | 2246176 | 4/1974 |
| DE | 102004015167 | 11/2005 |

(Continued)

*Primary Examiner* — Nicolas A Arnett
(74) *Attorney, Agent, or Firm* — Occhiuti & Rohlicek LLP

(57) ABSTRACT

A filling element includes a housing that forms a first dispensing opening. The first dispensing opening and a second dispensing opening provide corresponding filling jets. These jets combine to create a new jet for entry into a container to be filled. The first dispensing opening is offset outward radially opposite the second dispensing opening.

12 Claims, 6 Drawing Sheets

(56) References Cited

U.S. PATENT DOCUMENTS

| | | | | |
|---|---|---|---|---|
| 9,120,066 | B2 * | 9/2015 | Meinzinger | B67C 3/02 |
| 2009/0095370 | A1 * | 4/2009 | Krulitsch | B67C 3/004<br>141/6 |
| 2009/0236007 | A1 * | 9/2009 | Clusserath | B65B 3/26<br>141/9 |
| 2009/0293985 | A1 * | 12/2009 | Till | B67C 3/2608<br>141/1 |
| 2010/0313959 | A1 * | 12/2010 | Termansen | B65B 39/004<br>137/1 |
| 2011/0000578 | A1 * | 1/2011 | Krulitsch | B67C 3/02<br>141/1 |
| 2011/0303325 | A1 * | 12/2011 | Gras | B67C 3/007<br>141/105 |
| 2012/0291898 | A1 * | 11/2012 | Auer | B65B 3/22<br>137/614.18 |

FOREIGN PATENT DOCUMENTS

| | | |
|---|---|---|
| DE | 102006017706 | 10/2007 |
| DE | 102010006005 | 7/2011 |
| GB | 2451251 | 1/2009 |
| JP | 2007069928 | 3/2007 |
| WO | WO2007/137727 | 12/2007 |
| WO | WO2009/013523 | 1/2009 |

* cited by examiner

FILLING ELEMENT AND FILLING SYSTEM

RELATED APPLICATIONS

This application is the national stage entry under 35 USC 371 of PCT/EP2012/004509, filed on Oct. 27, 2012, which claims the benefit of the Dec. 21, 2011 priority date of German application DE 10 2011 121 968.8, the contents of which are herein incorporated by reference.

FIELD OF INVENTION

The invention concerns container processing, and in particular, filling containers.

BACKGROUND

Filling elements for the filling of containers with liquid products or filling materials, in particular also with drinks, are known in various embodiments.

SUMMARY

The invention features a filling element that is suitable for the free-flow filling of containers and that allows an optimum filling, in particular also a clean filling with increased filling performance, measured as filling material quantity filled into the containers per unit of time.

The filling element according to the invention is made so that, at least during a part of the filling phase, during which the container is being filled with liquid filling material, the jet of filling material flowing into the container is formed by the combination of at least two partial flows of filling material or partial jets of filling material from a first dispensing opening and at least one further dispensing opening. The inner partial jet of filling material furthermore forms a kind of lead or guide flow to which the outer partial jet of filling material connects before entering the container. The first dispensing opening opposite further dispensing opening is offset radially outwards in relation to the filling element axis in the direction of which the filling material flows into the particular container.

In a preferred embodiment, the first dispensing opening is annular so that the partial jet of filling material emerging from the first dispensing opening is also annular shape and encloses the inner partial jet of filling material emerging from the other dispensing opening.

The first dispensing opening is preferably made so that the partial jet of filling material emerging from this dispensing opening is oriented towards the filling element axis, i.e. encloses an angle of less than 90° with it, which opens against the direction of flow of the filling material, i.e. upwards.

In one aspect, the invention features a filling element that includes a housing that forms a first dispensing opening. The first dispensing opening and a second dispensing opening provide corresponding filling jets. These jets combine to create a new jet for entry into a container to be filled. The first dispensing opening is offset outward radially opposite the second dispensing opening.

In another aspect, the invention features an apparatus for filling containers with liquid filling material. Such an apparatus includes a filling element. This filling element has a filling element housing, a first liquid channel through which liquid filling material flows during filling, a second liquid channel, a first liquid valve arranged in the first liquid channel, a valve body through which the second liquid channel extends, a first dispensing opening formed by the housing, and a second dispensing opening. The first liquid valve is controllable for opening and closing for controlled dispensing of filling material into a container through the first dispensing opening. This occurs by having the valve body move between a closed and opened position. The first and second dispensing openings dispense corresponding first and second partial jets of filling material. These can be the same or different filling materials. The partial jets join to form a joint jet of filling material flowing to the container in a direction of a filling element axis. Relative to the filling element axis, the first dispensing opening is offset outward radially opposite the second dispensing opening.

In one embodiment, the filling element is configured for free-flow filling of a container.

In another embodiment, the first dispensing opening is made so that the first partial jet of filling material emerging from the first dispensing opening is oriented towards the filling element axis.

In yet another embodiment, the first dispensing opening is made so that the first partial jet of filling material emerging from the first dispensing opening encloses an angle of almost 90° with the filling element axis, which opens against a direction of flow of the filling material.

In some embodiments, at least one of the first and second dispensing openings is annular, and encloses the filling element axis.

In others, at least one of the first and second dispensing openings is formed by a plurality of individual openings arranged in an annulus that encloses the filling element axis.

Among the embodiments are those that also a pipe-type valve plunger having an open end, and a valve body, with the second dispensing opening being formed by the open end.

Additional embodiments have an opening that connects a section of the first liquid channel to the second liquid channel, the section being disposed upstream of the first liquid valve.

Also among the embodiments are those that include a connection between the first liquid channel and a vat that supplies the filling material, and a second liquid valve is provided in the connection.

Other embodiments include a connection between the first and second liquid channels, and a second valve provided in the connection.

In alternative embodiments, there is a second liquid valve that controls flow of filling material from a vat to the second liquid channel.

In some embodiments, the first and second dispensing openings are axially offset along the filling element axis. Among these are those in which the second dispensing opening is located lower than the first dispensing opening.

Yet other embodiments include a rotary filling machine, wherein the filling element and a plurality of additional filling elements, each of which is identical to the filling element, are disposed on the rotary filling machine.

It has surprisingly been shown that the partial jets of filling material generated by the design according to the invention, and that join together to form a joint jet of filling material after emerging from the filling element and preferably still before entering the particular container, lead to a substantial increase in the filling performance, measured as the filling volume per unit of time, for example to an increase of up to 20%. Particularly advantageous is that this increase in performance can be achieved without any significant foaming of the filling material during the filling process.

As used herein, the expressions "substantially" or "approximately" mean deviations from exact values in each case by +/−10%, and preferably by +/−5% and/or deviations in the form of changes not significant for functioning.

As used herein, "free-flow filling" means a process in which the liquid filling material flows to the container to be filled in a free filling jet or jet of filling material, wherein the container does not lie against the filling element by its mouth or opening, but is at a distance from the filling element or from a filling material outlet there.

As used herein, "containers" means cans, also soft packs, for example those made of cardboard and/or plastic film and/or metal foil.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

The invention is explained in more detail below by means of the figures using examples of embodiments. The following are shown.

DETAILED DESCRIPTION

Figure 1:
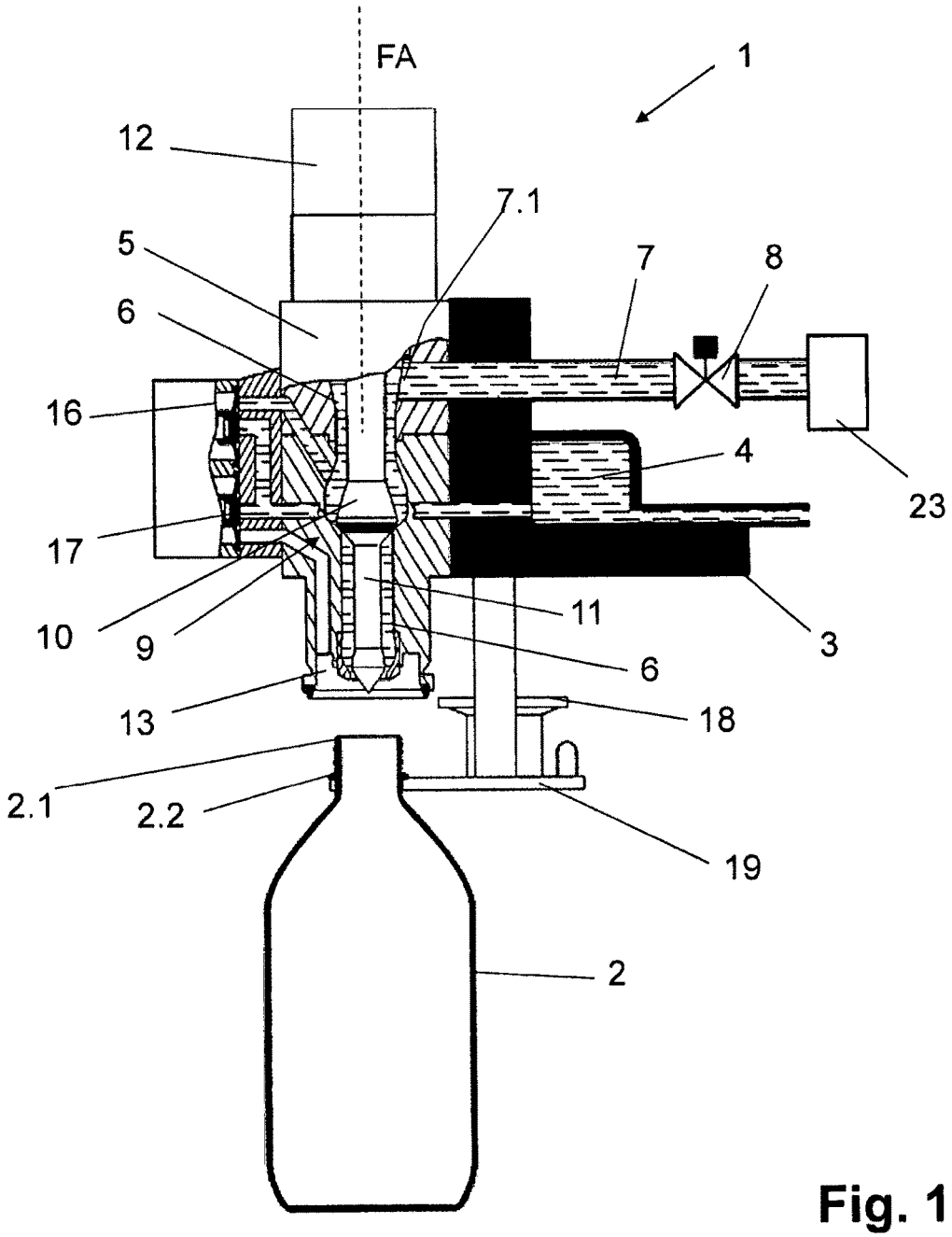
FIG. 1 in a simplified representation and in cross-section, a filling element of a filling system of a rotary filling machine for the free-flow filling of containers in the form of bottles with a liquid filling material.
Figure 2:
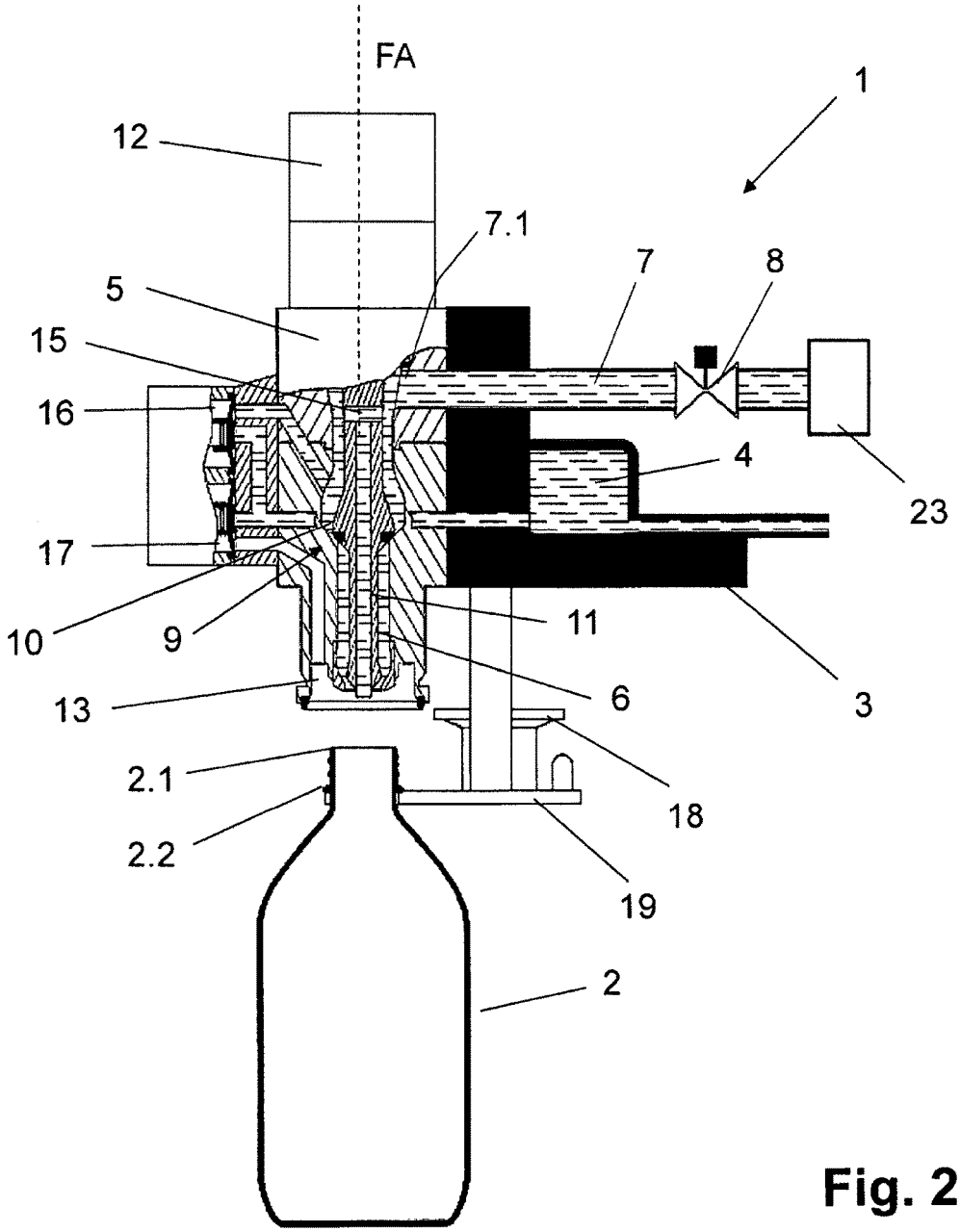
FIG. 2 is a cross-section of a valve plunger and valve body, shown in cross-section, of a liquid valve of the filling element shown in FIG. 1.
Figure 3:
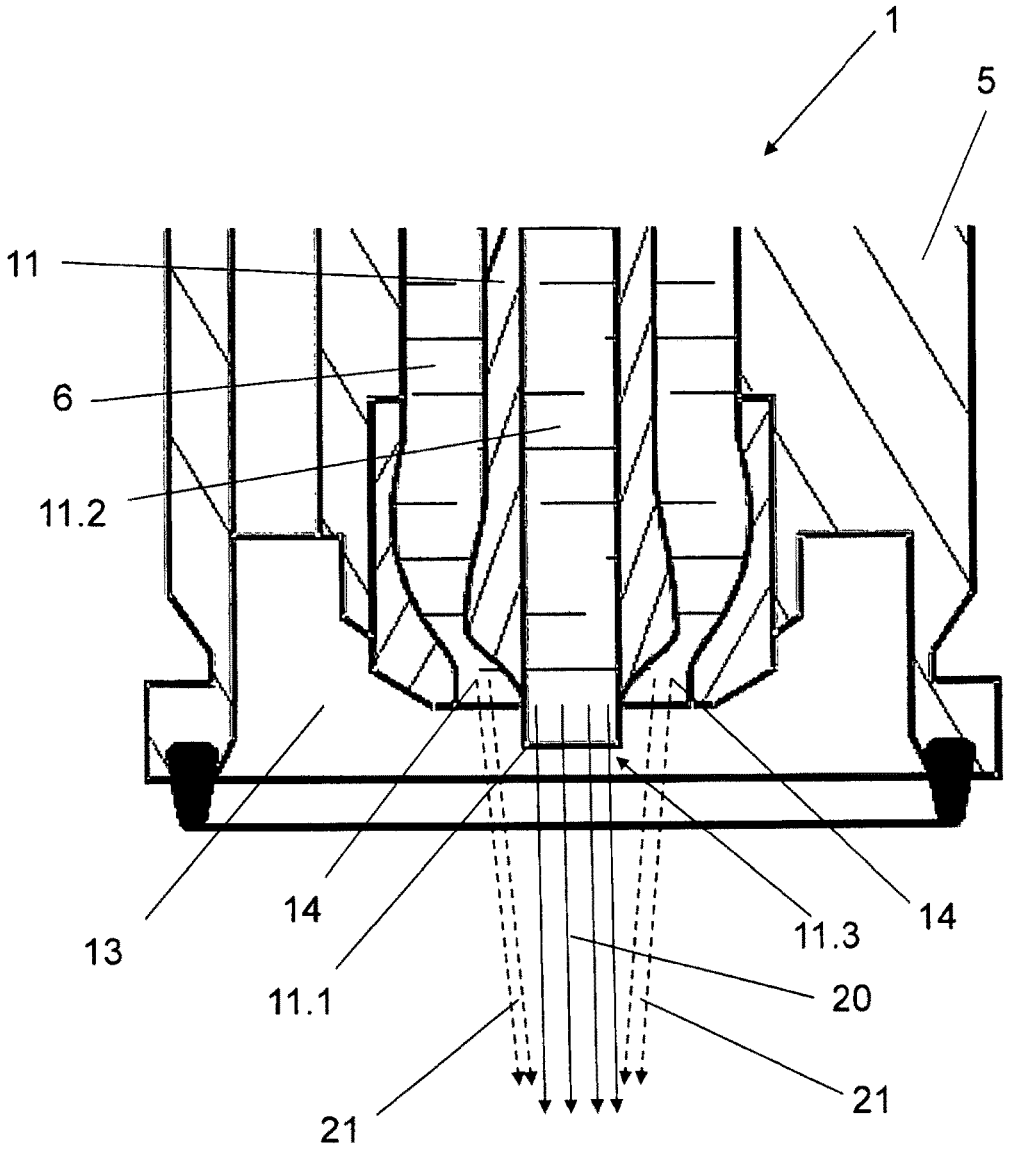
FIG. 3 is a magnified partial representation and in cross-section, the filling element of FIGS. 1 and 2 in the area of the underside of the filling element or in the area of a central or middle dispensing opening and an annular dispensing opening enclosing the latter.

FIGS. 1-3 show a filling element 1 for the free-flow filling of containers, in the form of bottles 2, with a liquid filling material. The filling element 1 is provided, with a plurality of the same kind of filling elements 1, on the circumference of a rotor 3 that can be driven to rotate around a vertical machine axis. The rotor 3 is part of a filling system or of a rotary filling machine.

A filling material vat, which is omitted from the figure, is on the rotor 3. The vat, which can be an annular vat, supplies filling material to all the filling elements jointly. Also on the rotor is annular channel 4 that likewise jointly serves all the filling elements 1.

The filling element 1 comprises a filling element housing 5, in which is formed a first liquid channel 6. A product line 7, with a first liquid valve 8, connects the common filling material vat to an upper area of the first liquid channel 6. An inlet opening 7.1 provides fluid communication between the product line 7 and the first liquid channel 6. The axis of the liquid channel is horizontal or substantially horizontal, i.e. perpendicular to a filling element axis FA. As a result, liquid filling material enters the first liquid channel 6 in a direction of flow that is radially outwards relative to a vertical machine axis.

A second liquid valve 9 is provided in the first liquid channel 6. In the illustrated embodiment, the second liquid valve 9 includes a valve body 10 interacting with a valve seat in the first liquid channel 6. The valve body 10 can be moved in the direction of the filling element axis FA to open and close the second liquid valve 9. The valve body 10 is moreover provided on a pipe 11, arranged on the same axis as the filling element axis FA, that acts as a valve plunger. An upper end of the pipe, not illustrated in detail in the figures, is sealed and routed out from the first liquid channel 6 and interacts with an actuation device 12.

On the underside of the filling element 1, or in an annular space 13 that opens to this underside, the first liquid channel 6 forms a first dispensing opening 14 that encloses the filling element axis FA in an annular manner. The first dispensing opening 14 is an annular gap between an outer surface of the pipe 11 and an inner surface of the first liquid channel 6. A lower open pipe end 11.1 of the pipe 11 projects into the annular space 13. In the illustrated embodiment, the second liquid valve 9 is located in the direction of flow of the liquid filling material through the first liquid channel 6 at a relatively large axial distance from the first dispensing opening 14. As a result, the second liquid valve 9 divides the first liquid channel 6 into an upper section and a lower section. The upper and lower sections have approximately the same axial length.

As FIGS. 2 and 3 in particular show, a second liquid channel 11.2 formed in the pipe 11 is opens both at its lower end 11.1 and into the upper section of the first liquid channel 6, i.e. in that section of the liquid channel that lies downstream of the liquid valve 9 relative to the direction of flow of the liquid filling material. This opening is produced, for example, by a crosswise hole 15 that is oriented with its axis perpendicular or substantially perpendicular to the filling element axis FA. The crosswise hole 15 in the illustrated embodiment is arranged such that, with the liquid valve 9 open, i.e. with the valve body 10 raised, the hole 15 is congruent or substantially congruent to the inlet opening 7.1 of the product line 7.

In the housing 5 of the filling element 1, moreover additionally various flow paths are formed that can be controlled by closed control valves 16, 17 in the non-activated state, thus a flow path by means of which the upper section of the first liquid channel 6 can be connected to the annular channel 4 by activating or opening the control valve 16, and a further flow path by means of which the annular space 13 can be connected to the annular channel 4 by activating or opening the control valve 17, or however the annular channel 4 can be connected both to the annular channel 13 and also the first liquid channel 6 by activating or opening both control valves 17. By means of the controlled flow paths or the control valves 16 and 17, an intensive CIP cleaning and/or sterilization of the filling elements 1 of the filling machine is possible with an annular space 13 closed with a closure or with a rinsing cap 18 and with the first and second liquid valves 8, 9 open.

In the normal filling operation, the control valves 16, 17 are closed. The bottle 2 to be filled is held with its bottle axis on the same axis as the filling element axis FA and with its bottle mouth 2.1 at a distance underneath the first dispensing opening 14, this being with its mouth flange 2.2 suspended on a container carrier 19 assigned to each filling element 1.

The filling of the bottle 2 takes place preferably in such a way that, at the start of the filling process, i.e. in a quick filling phase, both the first and second liquid valves 8 and 9 are opened so that the liquid filling material on the one hand is dispensed by means of the lower open pipe end 11.1 likewise forming a dispensing opening 11.1 as a central jet of filling material 20 and on the other by means of the annular first dispensing opening 14 as the annular jet of filling material 21 enclosing the jet of filling material 20 on the underside of the filling element, as indicated in FIG. 3 by the arrows there. Both jets of filling material 20, 21 combine into to a joint jet of filling material that then flows into the bottle 2 in the direction of the filling element axis FA.

It has surprisingly been discovered that combining the central partial jet of filling material 20 emerging from the lower pipe end 11.1 and the annular partial jet of filling material 21 emerging from the first dispensing opening 14, which joins with the partial jet of filling material 20 before entering the bottle 2 and is drawn along with it, results in a high filling performance and achieves a clean filling of the bottles 2 without any foaming and without the risk of spraying filling material despite the centrifugal forces resulting from the rotation of the rotor 3 and acting on the partial jets of filling material 20 and 21, and on the joint jet of filling material.

At the end of the fast filling phase, a slow filling phase begins. The slow filling phase is characterized by a reduced flow of filling material. During the slow filling phase, one of the first and second liquid valves 8 and 9, is closed. In a preferred embodiment, the second liquid valve 9 is closed. Once the target filling quantity has been reached, whichever liquid valve 8, 9 is still open during the slow filling, which in the preferred embodiment would be the first liquid valve 8, is also closed. The closure of both liquid valves 8, 9 ends the filling operation. The bottle 2, which has now been filled with the target filling quantity, is then removed from the filling element 1 or the container carrier 19.

Figure 4:
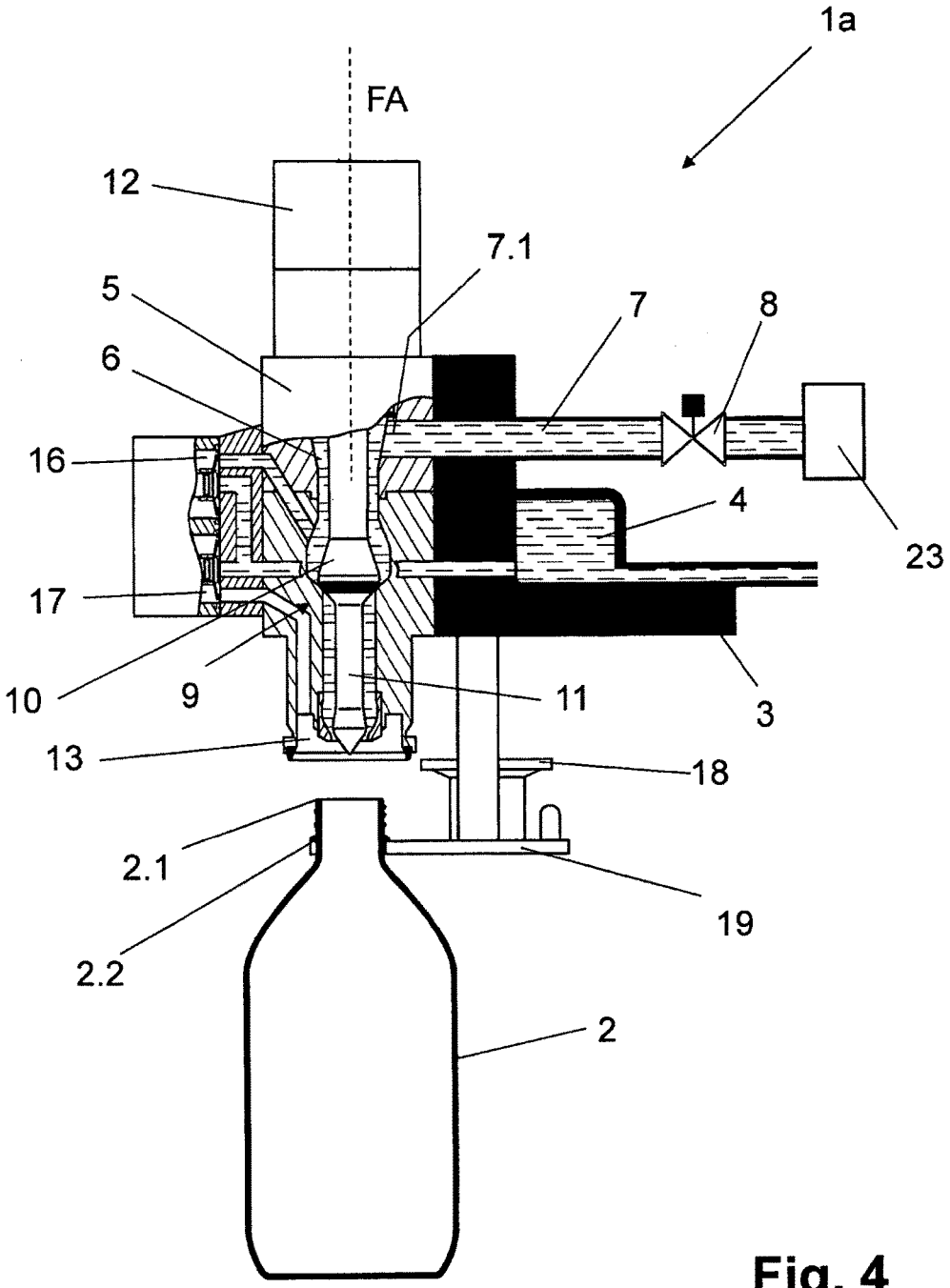
FIGS. 4-6 illustrate a further embodiment of the filling element according to the invention.
Figure 5:
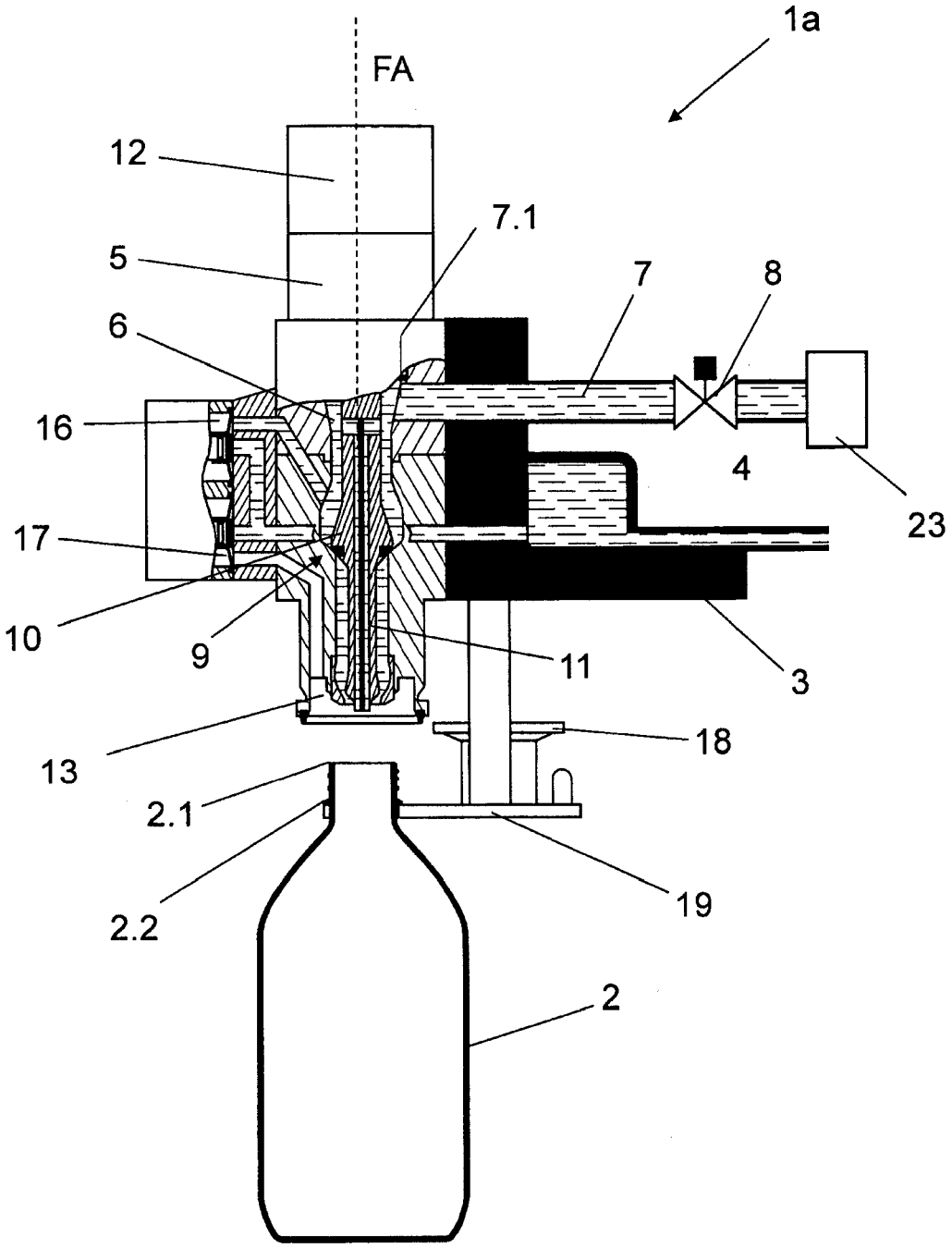
Figure 6:
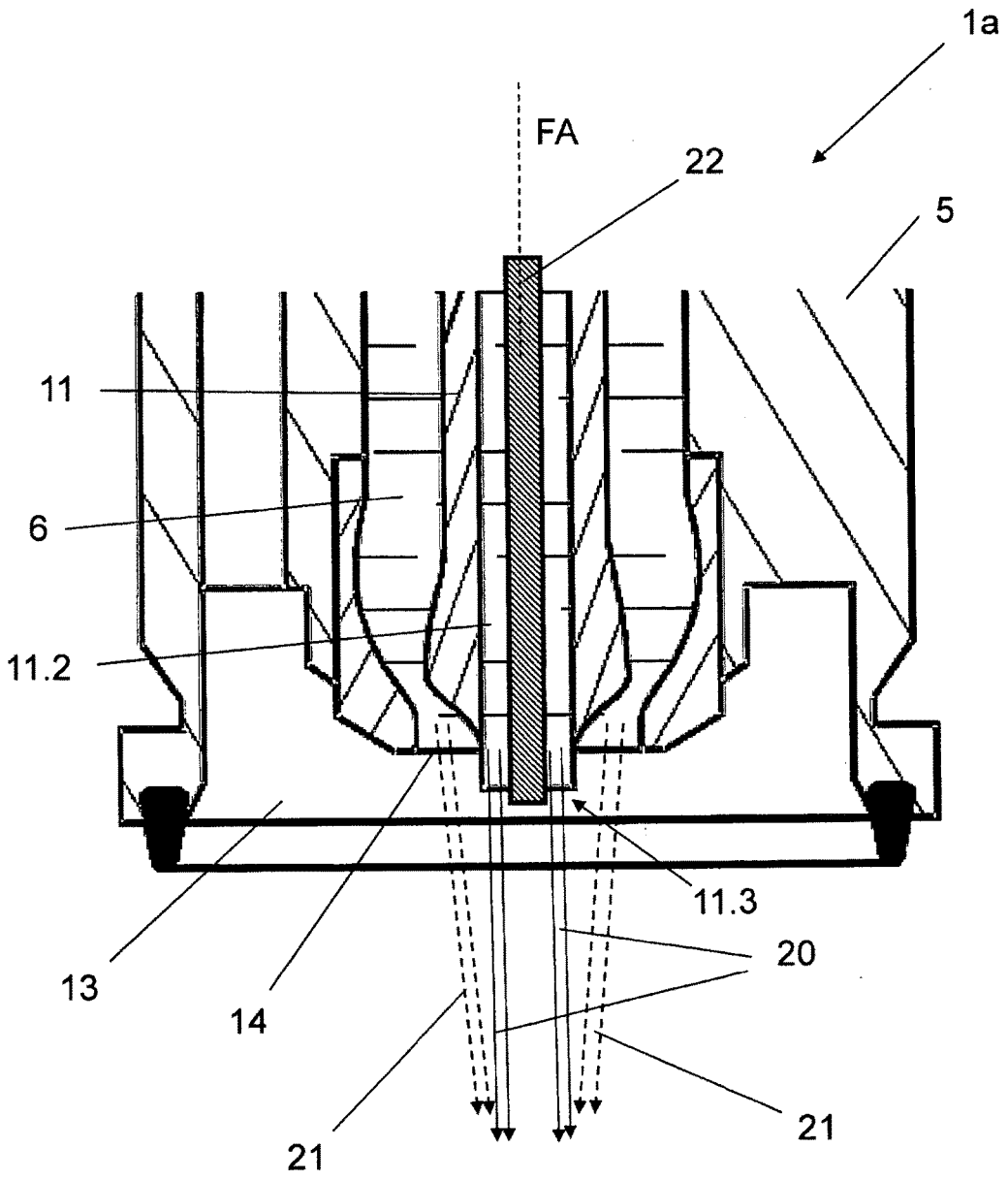

FIGS. 4-6 show a second embodiment of a filling element 1*a* that differs from the first embodiment of the filling element 1 substantially only in that, within the pipe 11, there is a rod 22 arranged on the same axis as the filling element axis FA. In the illustrated embodiment, the rod 22 projects by its lower end slightly beyond the lower end 11.1 of the pipe 11. A space between the inner surface of the pipe 11 and the outer surface of the rod 22 defines a second liquid channel 11.2. The second liquid channel 11.2, which is annular, opens via a crosswise hole 15 into the first liquid channel 6 and forms an annular second dispensing opening 11.3 at the lower pipe end 11.1. The rest of the construction and also the method of functioning of the filling element 1*a* are identical to the structure and the method of functioning of the filling element 1. The annular second liquid channel 11.2 formed by the rod 22 cooperates with the annular second dispensing opening 11.3 to further improve flow behavior of the liquid filling material at the emergence at the lower end of the pipe 11 and thus further improves the jet of filling material flowing to the particular bottle 2 during the fast filling phase.

A flow meter 23 is individually provided in the product pipe associated with each filling element 1, 1*a*. This flow meter 23 enables control over the quantity of filling material introduced into a bottle 2 by the first and second dispensing openings 14, 11.3. Preferably, the flow meter 23 is a magnetically inductive flow meter. Alternatively, a weighing device formed on the container carrier 19 records the current weight of the bottle 2.

The invention described above is suitable for the filling of juices containing fruit fibers and/or fruit cells, wherein the length of these fruit fibers can be as long as 25 mm. This suitability for arises because the filling valve has installation parts that would prevent solids from flowing through it.

A further aspect of the present invention includes selecting the diameter of the liquid channel in the pipe 11 such that the capillary forces and/or the surface tension of the filling material prevent leaking of the liquid channel after the closure of the first and second liquid valves 8, 9. The leaking of the liquid channel could be reliably prevented for example with a diameter of 6 mm for the filling of juice, and with a diameter of, for example 8 mm to 9 mm, for the filling of syrup.

The invention was described above using examples of embodiments. It is clear that modifications and variations are possible without thereby departing from the inventive idea underlying the invention.

In the foregoing embodiments, the same filling material flows through both dispensing openings. However, it is possible to mix two components together by connecting one dispensing opening to a supply of a first component, and the other dispensing opening to a supply of a second component. The two components would then mix when the two partial jets combine into a joint jet. In this embodiment, the second liquid channel 11.2 is separated from the first liquid channel 6 by eliminating the crosswise hole 15. The second liquid channel 11.2 is connected, by a separate product line containing a control or liquid valve, to a vat for the supply of one component of the filling material. The first liquid channel 6 is connected to another vat for the supply of the other components of the filling material by the product line 7, which then does not have the control valve 8.

Having described the invention, and a preferred embodiment thereof, what we claim as new, and secured by Letters Patent is:

1. An apparatus for filling containers with a liquid filling material, said apparatus comprising a filling element, said filling element comprising a filling element housing, first and second liquid channels through which said liquid filling material flows, first and second dispensing openings corresponding to said first and second liquid channels through which said liquid filling material exits said first and second liquid channels, and a first liquid valve arranged in said first liquid channel, said first liquid valve being controllable for opening and closing to permit controlled dispensing of said liquid filling material into a container through said first dispensing opening, wherein, during filling, said liquid filling material flows through said first liquid channel and through said first dispensing opening, a valve body that moves between a closed and opened position to control said first liquid valve, and a pipe that is configured to function as a valve plunger, said pipe extending downward from said valve body, having an open end that forms said second dispensing opening, and cooperating with said filling-element housing to form said first dispensing opening, wherein said first dispensing opening dispenses a first partial jet of liquid filling material, wherein said second liquid channel extends through said valve body, exits said valve body, continues through said pipe, and terminates at said second dispensing opening through which is dispensed a second partial jet of said liquid filling material, said first and second partial jets being consubstantial, wherein said second partial jet joins said first partial jet of said liquid filling material to form a combined jet of said liquid filling material that flows toward said container in a direction of a filling element axis, wherein liquid filling material in said first partial jet and liquid filling material in said second partial jet are one and the same liquid filling material, and wherein, relative to said filling element axis, said first dispensing opening is offset outward radially opposite said second dispensing opening.

2. The apparatus of claim 1, wherein said first dispensing opening is made so that said first partial jet of said liquid filling material emerging from said first dispensing opening is oriented towards said filling element axis.

3. The apparatus of claim 1, wherein said first dispensing opening is made so that said first partial jet of said liquid filling material emerging from said first dispensing opening encloses an angle of almost 90° with said filling element axis, which opens against a direction of flow of said liquid filling material.

4. The apparatus of claim 1, wherein at least one of said first and second dispensing openings is annular, and encloses said filling element axis.

5. The apparatus of claim 1, wherein at least one of said first and second dispensing openings is formed by a plurality of individual openings arranged in an annulus that encloses said filling element axis.

6. The apparatus of claim 1, further comprising an opening that connects a section of said first liquid channel to said second liquid channel, wherein said section is disposed upstream of said first liquid valve.

7. The apparatus of claim 1, further comprising a vat, a connection between said first liquid channel and said vat, and a second liquid valve, wherein said second liquid valve is provided in said connection, wherein said vat supplies said liquid filling material to said first and second liquid channels.

8. The apparatus of claim 1, further comprising an opening upstream of said dispensing openings for providing a connection between said first and second liquid channels.

9. The apparatus of claim 1, further comprising a vat and a second liquid valve, wherein said second liquid valve controls flow of said liquid filling material from said vat to said second liquid channel.

10. The apparatus of claim 1, wherein said first dispensing opening and said second dispensing opening are axially offset along said filling element axis.

11. The apparatus of claim 10, wherein said second dispensing opening is located lower than said first dispensing opening.

12. The apparatus of claim 1, further comprising rotary filling machine, wherein said filling element and a plurality of additional filling elements, each of which is identical to said filling element, are disposed on said rotary filling machine.

* * * * *